United States Patent [19]

Cartner

[11] Patent Number: 4,756,235

[45] Date of Patent: Jul. 12, 1988

[54] MOTOR CONTROL VALVE ASSEMBLY

[76] Inventor: Jack O. Cartner, 1005 N. Eighth, Cambridge, Ohio 43725

[21] Appl. No.: 907,839

[22] Filed: Sep. 15, 1986

[51] Int. Cl.[4] ..... F15B 13/044

[52] U.S. Cl. ..... 91/459; 91/461; 60/468

[58] Field of Search ..... 91/461, 459; 60/325, 60/468

[56] References Cited

U.S. PATENT DOCUMENTS

| | | | |
|---|---|---|---|
| 4,194,365 | 3/1980 | Stoufflet et al. | 60/468 |
| 4,362,018 | 12/1982 | Torii | 60/468 |
| 4,495,754 | 1/1985 | Cartner | 91/422 X |
| 4,606,258 | 8/1986 | Kauss | 91/461 X |
| 4,612,845 | 9/1986 | Burkel et al. | 91/459 X |

*Primary Examiner*—William E. Wayner

*Attorney, Agent, or Firm*—Fay, Sharpe, Beall, Fagan, Minnich & McKee

[57] ABSTRACT

A hydraulic valve assembly which can be used for controlling a motor or the like includes a first directional control member which selectively allows hydraulic fluid to flow from an associated hydraulic pump through a hydraulic fluid circuit to an associated reservoir and to an associated hydraulic motor. A second directional control member is connected to the fluid circuit for selectively allowing hydraulic fluid to flow directly to the associated reservoir as directed by the first member. A third directional control member is connected to the fluid circuit for selectively allowing hydraulic fluid to flow directly to the associated hydraulic motor as directed by the first member. A relief member is operatively connected with the fluid circuit for allowing hydraulic fluid to be relieved from the assembly to the associated reservoir.

14 Claims, 1 Drawing Sheet

MOTOR CONTROL VALVE ASSEMBLY

BACKGROUND OF THE INVENTION

The present invention relates to the art of controlling the actuation of a hydraulic output power unit. More specifically, the present invention relates to a valve assembly adapted for the actuation of a hydraulic motor.

The invention is particularly applicable to controlling the actuation of a hydraulic motor used for powering tractor mounted ditchers, mowers, sickle bars and other cutting apparatus utilized in the art of roadside maintenance and will be described with particular reference thereto. However, it will be appreciated by those skilled in the art that the invention has broader application and may also be adapted for use in many other environments.

Heretofore, various cutting tools have been mounted to tractors or other prime movers by assemblies which hold the cutting apparatus to the side of the tractor for cutting away vegetation or earth as may be required for road maintenance. Conventionally, a control valve utilized for controlling the operation of a hydraulic motor on such mobile cutting apparatus included a manual operating lever for controlling the flow rate of hydraulic fluid pumped therethrough. Each control valve also had a recirculating port for returning excess hydraulic fluid back to a reservoir via return lines. A pressure output line was connected with a hydraulic motor to power the motor. However, such conventional control valves have been prone to various problems.

Accordingly, it has been considered desirable to develop a new and improved valve assembly which would overcome the foregoing difficulties and others while providing better and more advantageous overall results.

BRIEF SUMMARY OF THE INVENTION

In accordance with the present invention, a new and improved hydraulic valve assembly is provided for controlling the operation of a motor or the like.

More particularly in accordance with the invention, the assembly comprises a first directional control means for selectively allowing hydraulic fluid to flow from an associated hydraulic pump means through a hydraulic fluid circuit to an associated reservoir and to an associated hydraulic motor. A second directional control means, which is connected to the fluid circuit, is also provided for selectively allowing hydraulic fluid to flow directly to the associated reservoir as directed by the first means. A third directional control means, which is connected to said fluid circuit, is provided for selectively allowing hydraulic fluid to flow directly to the associated hydraulic motor as directed by the first means. A relief means, which is operatively connected to the fluid line, is provided for allowing hydraulic fluid to be relieved to the associated reservoir.

In accordance with another aspect of the invention, the assembly further comprises a valve housing in which the fluid circuit is defined and the first, second and third directional control means are positioned. Preferably, the relief means is also located in the valve housing.

According to another aspect of the invention, the first directional control means includes a solenoid operated actuator system. Preferably, the first directional control means is a two-way, three-position directional control valve.

According to a further aspect of the invention, the second directional control means includes a pilot operated actuator system. Preferably, the second directional control means is a two-way, two-position directional control valve.

In accordance with a still further aspect of the invention, the third directional control means includes a pilot operated actuator system. Preferably, the third directional control means includes a two-way, two-position directional control valve.

According to still another aspect of the invention, the relief means includes a relief valve which can, preferably, be set to approximately 2,250 psi.

According yet another aspect of the invention, a hydraulic valve assembly is provided for controlling the operation of a hydraulic motor or the like.

In accordance with this aspect of the invention, a first pilot actuated valve is provided for selectively allowing hydraulic fluid to flow directly from an associated hydraulic pump through a hydraulic fluid line directly to an associated reservoir. A second pilot actuated valve is provided for selectively allowing hydraulic fluid to flow directly from the associated hydraulic pump through the hydraulic fluid line directly to an associated hydraulic motor. A solenoid actuated control valve, which is operatively connected to the hydraulic fluid line, is provided for allowing selective actuation of the first and second pilot operated valves.

In accordance with another aspect of this invention, a relief valve, which is operatively connected to the hydraulic fluid line, is provided for relieving overpressure conditions in the valve assembly.

One advantage of the present invention is the provision of a new and improved hydraulic valve assembly, which is preferably contained in one integral body, for controlling the operation of a hydraulic motor or the like.

Another advantage of the invention is the provision of a valve assembly which includes a solenoid operated control valve for allowing selective actuation of a pair of pilot operated valves to vent pressurized hydraulic fluid from a pump through a hydraulic fluid line either to a reservoir or to a hydraulic motor depending on the setting of the control valve.

Still another advantage of the invention is the provision of a relief valve which is operatively connected to the hydraulic fluid line to relieve overpressure conditions in the valve assembly.

Yet a further advantage of the invention is the provision of a unitary valve housing in which a fluid passageway network is defined and in which first and second pilot operated valves and a solenoid operated control valve, which may all be cartridge-type valves, are positioned.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
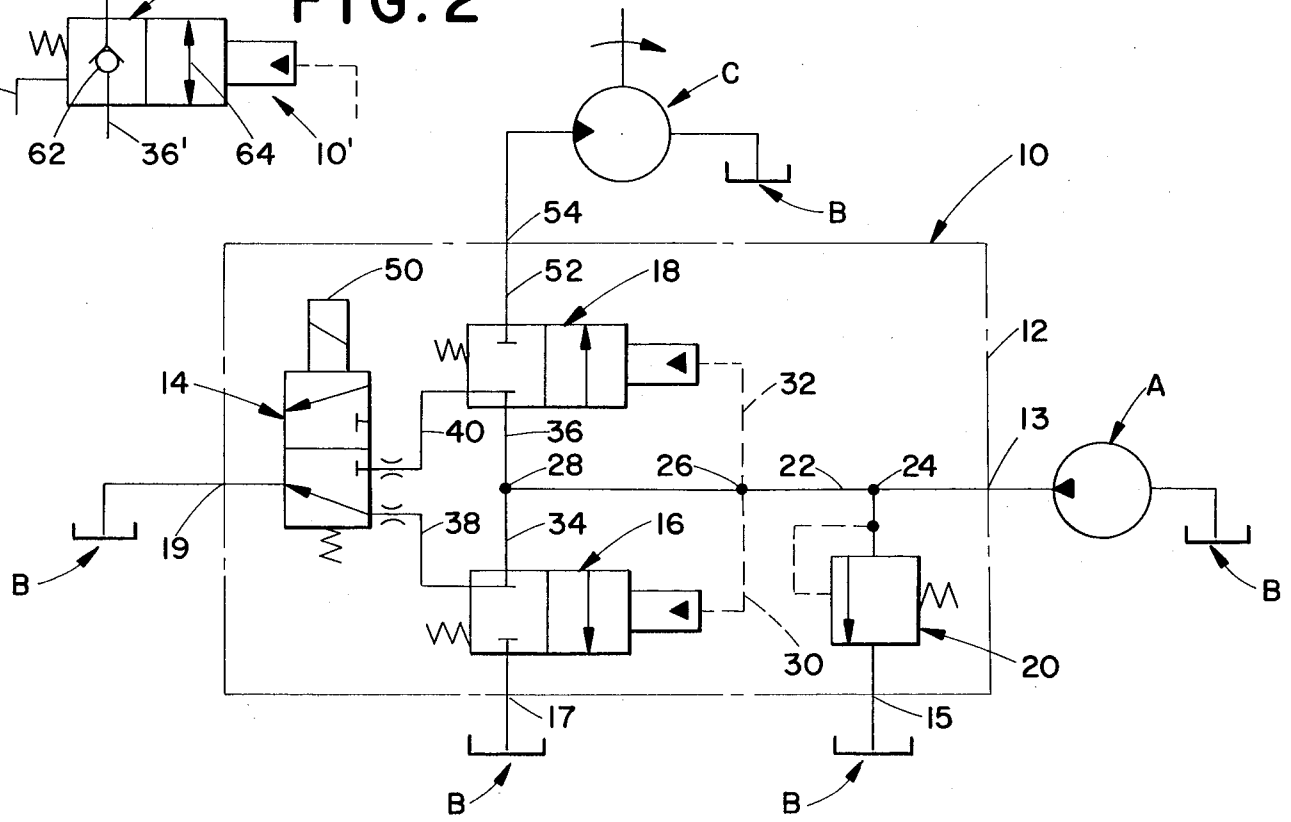
FIG. 1 is a hydraulic schematic of the valve assembly according to a first preferred embodiment of the present invention; and, FIG. 2 is a hydraulic schematic of a pilot operated valve portion of the valve assembly illustrating a second preferred embodiment of the present invention.

Referring now to the drawings wherein the showings are for purposes of illustrating preferred embodiments of the invention only and not for purposes of limiting same, FIG. 1 shows the subject new hydraulic valve assembly designated generally by the numeral 10. While the valve assembly is primarily designed for and will hereinafter be described in connection with the regulation of a hydraulic motor utilized in conjunction with rotary brush and grass mowing and cutting apparatus for trimming highway medians and shoulders or a ditching apparatus utilized for cutting away earth as may be required for road maintenance, it will be appreciated that the overall inventive concept involved could be adapted for use in other hydraulic power environments as well.

More particularly, the present invention includes a control valve assembly 10 whose enclosure or housing 12 is delineated by a rectangular perimeter that is shown in a dash and dot line. Inside the enclosure 12 are located four hydraulic components which are interconnected with a net work of hydraulic passageways depicted with solid lines indicating main hydraulic lines and dashed lines indicating pilot lines.

A first directional control means 14 preferably comprises a solenoid operated control means, such as a three-way, two-position spring returned control valve. A second directional control means 16 preferably comprises a pilot operated actuator means, such as a two-way, two-position spring returned control valve. A third directional control means 18 preferably comprises a second pilot operated actuator means, such as a two-way, two-position spring returned directional control valve. Finally, a relief means 20 preferably comprises a relief valve which can be a spring offset pilot shift relief valve.

The housing 12 is preferably a unitary structure in which a plurality of fluid passageways are defined for interconnecting the valves 14, 16, 18 and 20. The valves can be cartridge valves which are positioned in the housing 12.

It should be noted at this point that the members illustrated outside of the housing 12 are included for the purpose of explaining the environment within which the valve assembly 10 operates. In this connection, a fixed displacement pump A is illustrated which draws hydraulic fluid from a reservoir B and supplies pressurized hydraulic fluid to the valve assembly 10 at a port 13. Also illustrated is a fixed displacement hydraulic motor C, to whose output shaft some load, such as the various cutting tools (e.g. ditchers, mowers, sickle bars, and the like) which can be mounted to a tractor or other prime mover, would normally be connected. An output of the motor is also vented to the reservoir B. An additional reservoir, also identified by the letter B, is illustrated on the left-hand side of the housing 12. It is noted that the reservoir member B is shown at five different locations within FIG. 1, first in connection with the hydraulic pump A, then in connection with the hydraulic motor C and adjacent to three ports of the housing 12, namely at 15, 17, and 19.

It is generally recognized that in the design of a hydraulic system, there would only be one reservoir. Thus, all five pictorial representations of the reservoir preferably refer to only one reservoir which is the reason why all the illustrations of the reservoir are identified by the letter B. This diagramming method is consistent with internationally accepted graphic practices and is used to simplify the pictorial representation of the various members and elements that make up the hydraulic circuit diagram.

A conventional prime mover (not shown) is normally coupled to the pump A. When this prime mover is started up, the pump starts to rotate drawing fluid from the reservoir B and delivering pressurized fluid through port 13 into a hydraulic fluid line 22 defined in the housing 12. The pressurized hydraulic fluid then flows to junction points 24, 26, and 28 along the line 24. At the first junction point 22, hydraulic fluid would attempt to flow through relief valve 20. Since this valve is normally in the blocked position, such flow is prevented unless the pressure relief setting thereof is exceeded. Preferably, in this particular design, the relief valve is set to open at approximately 2,250 psi. It should be recognized, however, that this setting is by no means a restricting or limiting pressure relief level since both higher and lower pressure setting can be utilized as desired or necessary.

At a second junction point 26, two additional fluid lines, namely pilot lines 30 and 32 are defined in the enclosure along which lines pilot actuating fluid can flow to shift the two-way, two-position valves 16 and 18. At the third junction point 28, two fluid lines 34 and 36 are defined. Hydraulic fluid is initially prevented from flowing through the valves 16 and 18 through the respective fluid lines 34 and 36 because the valves are in their blocked positions.

It is to be noted that before the pump A is actuated and while the first pilot operated valve 16 is in its blocked or spring biased position, the left chamber or envelope of the valve is vented to the reservoir B through restricted flow line 38 and the lower chamber of valve 14 as shown in FIG. 1. After the pump A is started and when the fluid in pilot line 30 exerts enough force on the spool of the pilot operated valve 16 to overcome the spring thereof, then the valve is shifted to its open position. The pressurized hydraulic fluid in line 34 can now return directly to the reservoir B via the valve 16 at near atmospheric pressure. While fluid is flowing through the lower fluid line 34, such flow is blocked through the upper fluid line 36. This is so since restricted flow line 40 which vents the left chamber of valve 18 is blocked while the valve 14 is in its first position as shown in FIG. 1.

However, when the solenoid 50 of the control valve 14 is energized, enough force is generated to overcome the force being exerted by the opposing spring, thus shifting the valve 14 to its upper chamber or envelope. The flow of fluid through line 38 is thereupon cut off and a pressurized column of fluid is trapped therein. The hydraulic force being exerted through the pilot line 30 cannot overcome the combined forces exerted by the opposing spring of valve 16 and the fluid pressure of the column of hydraulic fluid trapped in line 38. This actuates the valve 16 back to its closed position thereby blocking the further flow of fluid through the valve 16. Fluid in line 38 is now simply trapped.

Since the control valve 14 has shifted to its upper chamber, the fluid line 40, which interconnects the second pilot operated valve 18 and the control valve 14, enables the venting of the left chamber from valve 18. The fluid in pilot line 32 now exerts enough hydraulic force to shift the second pilot actuated valve 18 to the left against the force of the spring thereof so as to enable the right chamber thereof to connect a fluid line 52 with the motor C. Pressurized fluid can now flow out through port 54 to the hydraulic motor C which is thereupon actuated to begin rotation. Once it is rotating, the motor C can power a shaft of a suitable rotary mowing or cutting head of a road maintenance vehicle. Fluid leaving the hydraulic motor C returns directly to the reservoir B.

Although the motor C illustrated in FIG. 1, is shown as being able to rotate in one direction only, it is entirely feasible to substitute a bi-directional motor therefor.

When the solenoid 50 of valve 14 is again deenergized, the spring in valve 14 shifts the valve back to the position shown in FIG. 1. Now, flow through line 40 is blocked and flow through line 38 is once more permitted. This, again, vents the left chamber of the first pilot valve 16 to the reservoir through the lower chamber of the control valve 14 and the port 19. Valve 16 thereby is enabled to shift to the left once more providing a direct flow passageway to the port 17 from the pump A.

With the control valve having shifted back to the position shown in FIG. 1, a pressurized column of hydraulic fluid is trapped in line 40. This column of fluid and the spring of the valve 18 overcome the pressure exerted through the line 32 on the spool of valve 18 shifting the valve back to its position as shown in FIG. 1. Fluid flow to the motor C is thus blocked. Since pressurized fluid no longer flows to the hydraulic motor C, it stops rotating.

In other words, when the second pilot operated valve 18 prevents the flow of hydraulic fluid to the motor C, the cutter blade, or other mechanism, to which the motor is connected by conventional connecting means (not illustrated) windmills to a stop. There is preferably no external load induced on the connecting means connecting the motor and such cutter blade.

When the pump A is deactivated, the hydraulic fluid pressure in the pilot line of valve 16 becomes insufficient to overcome the spring force thereof. The valve 16 thus will shift back to its left to block further hydraulic fluid flow through port 17. However, continued flow of hydraulic fluid is still possible through restricted flow line 38 and the lower chamber of control valve 14 and out through port 19.

Figure 2:
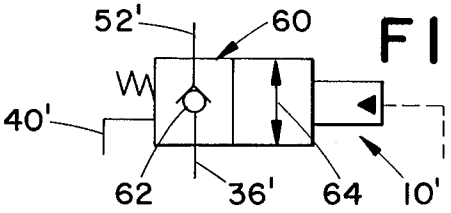

With reference now to the second preferred embodiment the invention as illustrated in of FIG. 2, the invention is there shown as utilizing a different type of pilot operated valve. For ease of illustration and appreciation of this alternative, like components are identified by like numerals with a primed (') suffix and new components are identified by new numerals.

In this FIGURE, the hydraulic valve assembly 10' is provided with a different type of pilot actuated valve 60 instead of the valve 18 of FIG. 1. In this type of pilot valve, the left envelope of each valve includes a check valve 62 instead of the blocked ports illustrated in FIG. 1. Such check valves may be advantageous under certain conditions. For example, it may be desirable to allow flow through line 52' and back through the check valve 62 when the pilot valve 60 has its left envelope in fluid connection with the lines 36' and 52'.

Additionally, in the valve 60, the right envelope thereof has a bore 64 permitting the two-way flow of fluid through the envelope. This may be advantageous in situations where the rotary head powered by the motor C encounters an obstruction, stops suddently, and sends a surge of hydraulic fluid back through line 52.

The invention has been described with reference to first and second preferred embodiments. Obviously, alterations and modifications will occur to others upon a reading and understanding of this specification. It is intended to include all such modifications and alterations insofar as they come within the scope of the appended claims or the equivalents thereof.

Having thus described the invention, it is now claimed:

1. A hydraulic valve assembly for controlling the operation of a hydraulic motor or the like, comprising:

a first pilot actuated valve for selectively allowing hydraulic fluid to flow from an associated hydraulic pump through a hydraulic fluid line directly to an associated reservoir;

a second pilot actuated valve for selectively allowing hydraulic fluid to flow from the associated hydraulic pump through said hydraulic fluid line directly to an associated hydraulic motor;

a solenoid actuated control valve operatively connected to said hydraulic fluid line, said control valve allowing selective actuation of said first and second pilot operated valves;

a first restricted flow line which communicates said first pilot actuated valve with said control valve; and, a second restricted flow line which communicates said second pilot actuated valve with said control valve.

2. The valve assembly of claim 1 further comprising a relief valve operatively connected to said hydraulic fluid line for relieving overpressure conditions in the valve assembly.

3. The valve assembly of claim 2 further comprising a housing in which said fluid line and said restricted flow lines are defined and said first and second pilot actuated valves, said solenoid actuated control valve and said relief valve are positioned.

4. The valve assembly of claim 2 wherein said relief valve is set to approximately 2,250 psi.

5. The valve assembly of claim 1 further comprising a valve housing in which said fluid line is defined and said first and second pilot actuated valves and said solenoid actuated control valve are positioned.

6. The valve assembly of claim 1 wherein at least one of said first and second pilot actuated valves has in one of its envelopes a check valve.

7. A hydraulic valve assembly for controlling the operation of a hydraulic motor, comprising:

a valve housing in which a fluid passageway network is defined;

a first two-way, two-positioned pilot operated valve which selectively allows hydraulic fluid to flow from an associated hydraulic pump through said network directly to an associated reservoir;

a second two-way, two-position pilot operated valve which selectively allows hydraulic fluid to flow from the associated hydraulic pump through said network directly to an associated hydraulic motor; and, a three-way, two-position solenoid operated control valve operatively connected to said network, said control valve allowing selective actuation of said first and second pilot operated valves.

8. The valve assembly of claim 7 further comprising a relief valve operatively connected to said network for relieving overpressure in said network.

9. The valve assembly of claim 7 wherein at least one of said first and second pilot actuated valves contains a check valve in one of its envelopes.

10. The valve assembly of claim 7 further comprising a first restricted flow line, which communicates said first two way valve with said solenoid operated control valve.

11. The valve assembly of claim 7 further comprising a second restricted flow line which communicates said second two way valve with said solenoid operated control valve.

12. The valve assembly of claim 7 wherein said first and second valves and said solenoid operated control valve are located in said valve housing.

13. The valve assembly of claim 8 wherein said relief valve is located in said valve housing.

14. The valve assembly of claim 8 wherein said relief valve is set to approximately 2,250 psi.

* * * * *